US009644593B2

(12) United States Patent
Pereira et al.

(10) Patent No.: US 9,644,593 B2
(45) Date of Patent: May 9, 2017

(54) COLD-CRANK EVENT MANAGEMENT

(71) Applicant: Freescale Semiconductor, Inc., Austin, TX (US)

(72) Inventors: Adriano Marques Pereira, Campinas (BR); Sunny Gupta, Noida (IN); Andre Luis Vilas Boas, Campinas (BR); Pedro Barbosa Zanetta, Campinas (BR); Ivan Carlos Ribeiro Nascimento, Campinas (BR); Carl Culshaw, Wigan (GB)

(73) Assignee: NXP USA, INC., Austin, TX (US)

( * ) Notice: Subject to any disclaimer, the term of this patent is extended or adjusted under 35 U.S.C. 154(b) by 371 days.

(21) Appl. No.: 14/166,891

(22) Filed: Jan. 29, 2014

(65) Prior Publication Data

US 2015/0211470 A1 Jul. 30, 2015

(51) Int. Cl.
*F02N 11/00* (2006.01)
*F02N 11/08* (2006.01)

(52) U.S. Cl.
CPC .... *F02N 11/0862* (2013.01); *F02N 2200/063* (2013.01); *F02N 2250/02* (2013.01)

(58) Field of Classification Search
CPC ..... F02N 11/0862; F02N 2200/063; F02N 2250/02
See application file for complete search history.

(56) References Cited

U.S. PATENT DOCUMENTS 5,095,438 A * 3/1992 Sasaki ..... F02D 41/249 701/114
5,159,217 A * 10/1992 Mortensen ..... H03K 17/22 327/143
5,619,156 A 4/1997 Jandu
5,968,178 A 10/1999 Williams et al.
6,249,739 B1 * 6/2001 Noehring ..... G06F 1/305 701/113
6,601,176 B1 * 7/2003 Alexander ..... G06F 1/24 713/1

(Continued)

OTHER PUBLICATIONS

Freescale Microcontroller Solution Group, "RAM Standby Regulator with source bias Block User Guide," Jul. 22, 2013, pp. 1-4 and 9-12.

*Primary Examiner* — Hieu T Vo
*Assistant Examiner* — Sherman Manley

(57) ABSTRACT

Systems and methods for managing cold-crank events. In an embodiment, a method may include detecting a cold-crank event and setting a switching circuit to a non-conductive state, where the switching circuit is configured to couple a first regulator to a memory circuit such that setting the switching circuit to the non-conductive state de-couples the memory circuit from the first regulator. The method may also include setting the switching circuit to a conductive state in current limitation mode during a recovery period following the cold-crank event to re-couple the memory circuit to the first regulator. In another embodiment, an electronic device include a switching circuit, a first regulator coupled to a first terminal of the switching circuit, a second regulator coupled to a second terminal of the switching circuit, a logic circuit coupled to the switching circuit, and a memory circuit coupled to the second terminal of the switching circuit.

13 Claims, 11 Drawing Sheets

(56) References Cited

U.S. PATENT DOCUMENTS

| | | | | |
|---|---|---|---|---|
| 8,242,815 | B2 * | 8/2012 | Scobie | G06F 1/24 327/143 |
| 8,253,453 | B2 | 8/2012 | Vilas Boas et al. | |
| 2004/0057324 | A1 | 3/2004 | Abe et al. | |
| 2005/0283304 | A1 * | 12/2005 | Endo | F02D 41/26 701/114 |

* cited by examiner

100

200

- PRIOR ART -

104

400

COLD-CRANK EVENT MANAGEMENT

FIELD

This disclosure relates generally to electronic circuits and devices, and more specifically, to systems and methods for managing cold-crank events.

BACKGROUND

An automotive battery is a rechargeable battery used to supply electric energy to automobiles and other transportation vehicles (e.g., cars, trucks, buses, motorcycles, trains, ships, boats, aircraft, etc.). A typical automotive battery may include a plurality of galvanic cells that provide, for example, 12 V at full charge. Generally, automotive batteries may be built to meet different specifications. In some cases, a single vehicle may have two or more batteries configured in series or in parallel.

In automotive applications, a "cold-crank event" can occur in the battery when an internal combustion engine is started—i.e., "cranked"—at low ambient temperatures, which causes the battery's voltage to drop to very low levels. For instance, in a 12 V system, a cold-crank event may drive the battery's nominal voltage to values as low as 5 V. As a consequence, certain electronic components in the automobile including, for instance, microcontrollers (MCUs), microprocessors, etc. may be negatively affected by the voltage drop. In many situations, these electronic components may be reset and/or their memory contents may be lost.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

In some embodiments, systems and methods described herein may enable detection of cold-crank events and may promote preservation of memory contents in response to those events. Additionally or alternatively, these systems and methods may provide a smooth transition from crank recovery to normal run mode. In some cases, a system and method for managing cold-crank events may be implemented without including additional pins or board components, and/or without a power or area increase simplifying circuit layout and reducing manufacturing and/or design costs.

Figure 1:
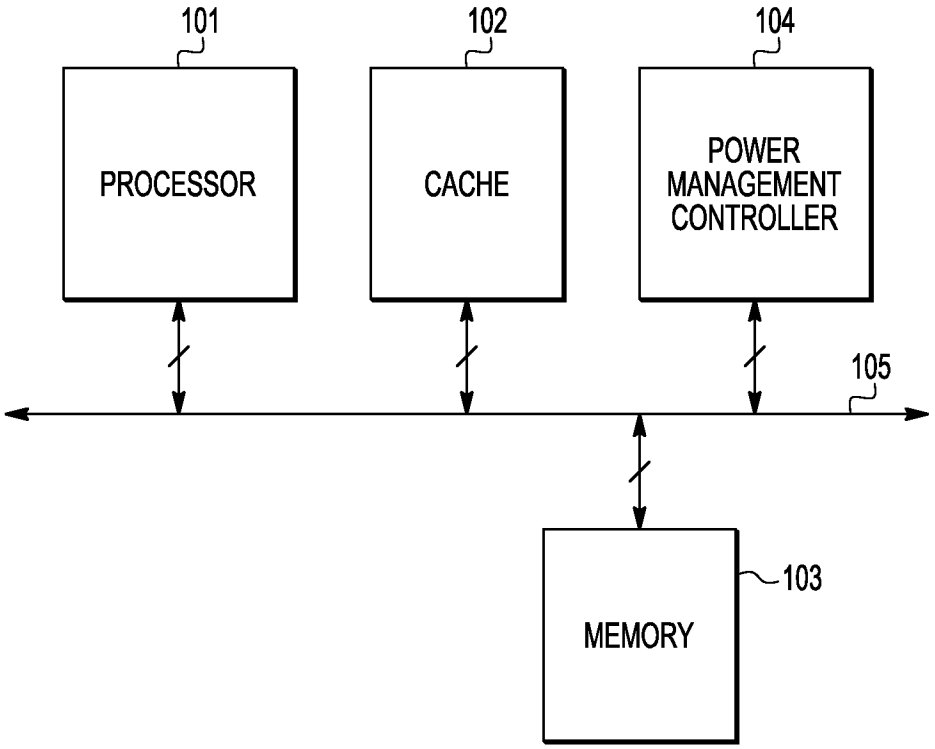
FIG. 1 is a block diagram of an example of an electronic component according to some embodiments.

FIG. 1 is a block diagram of an example of electronic component 100 according to some embodiments. In some cases, electronic component 100 may be configured to be used in an automobile or other vehicle and it may be powered, at least in part, by an external regulator which in turn is powered by an automotive battery or the like. Particularly, electronic component 100 includes processor 101, cache 102, system bus 105, memory 103, and Power Management Controller (PMC) 104.

Each of processor 101, cache 102, memory 103, and power management controller 104 may be coupled to system bus 105 via respective bidirectional electric conductors. Generally speaking, processor 101 may be configured to implement data processing operations, cache 102 may be configured to perform one or more caching operations, and memory 103 may be any type of electronic memory.

In operation, processor 101 may implement a variety of data processing functions by executing a plurality of data processing instructions. Cache 102 may temporarily store data that is frequently needed by processor 101. For example, cache 102 may be a set-associative multi-way cache which, in some embodiments, may be capable of storing multiple types of information, such as instruction information and data information (e.g., operand information). Information needed by processor 101 that is not within cache 102 may be stored in memory 103. PMC 104 may in turn operate to control the power supplies of electronic component 100 (not shown). Further operational aspects of processor 101, cache 102, memory 103, PMC 104, and system bus 105 are well understood in the art.

It should be noted that electronic component 100 is shown for sake of illustration only. In various implementations, electronic component 100 may include any number of elements, and these elements may be coupled to each other in any suitable manner. Also, in some implementations, two or more elements within component 100 may be fabricated on a single integrated circuit (IC) or on separate, discrete ICs.

In some embodiments, systems and methods for managing cold-crank events may be implemented within PMC 104 of electronic component 100 in FIG. 1. Accordingly, relevant portions of PMC 104 are discussed in more detail in connection with FIGS. 3-11.

Figure 2:
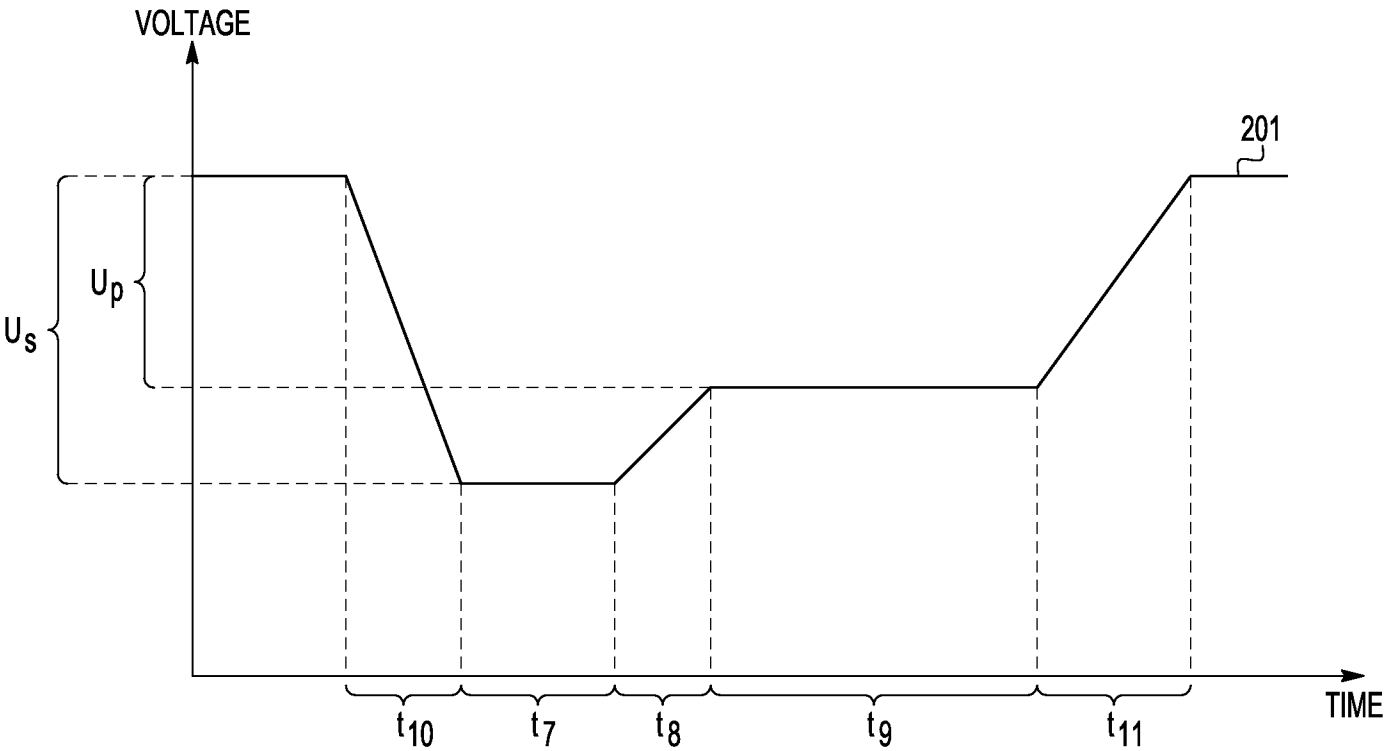
FIG. 2 show a prior art battery's output voltage during a cold-crank event.

As noted above, automotive applications may be subject to "cold-crank events" that can cause electronic component 100 to be reset and/or can erase the contents of memory 103. FIG. 2 show a battery's output voltage during a cold-crank event, and graph 200 includes curve 201 characteristic of such an event. Particularly, curve 201 demonstrates a battery's supply voltage reduction caused by the energizing of starter-motor circuits of an internal combustion engine, excluding any associated spikes. The various parameters of curve 201 are defined in the International Organization for Standardization (ISO) 7637-2 standard, some of which are depicted in Table I below:

TABLE I

| Parameters | 12 V system |
|---|---|
| $U_s$ | 4 V to 7 V |
| $U_p$ | 2.5 V to 6 V |
| $t_7$ | 15 ms to 40 ms |
| $t_8$ | =<50 ms |
| $t_9$ | 0.5 s to 20 s |
| $t_{10}$ | 5 ms |
| $t_{11}$ | 5 ms to 100 ms |

It is noted that some or all of the foregoing values may be agreed between the vehicle manufacturer and the equipment supplier to suit a proposed application. Accordingly, it should be understood that curve 201, although generally characteristic of cold-crank events, is provided for sake of illustration only and numerous variations are possible.

Figure 3:
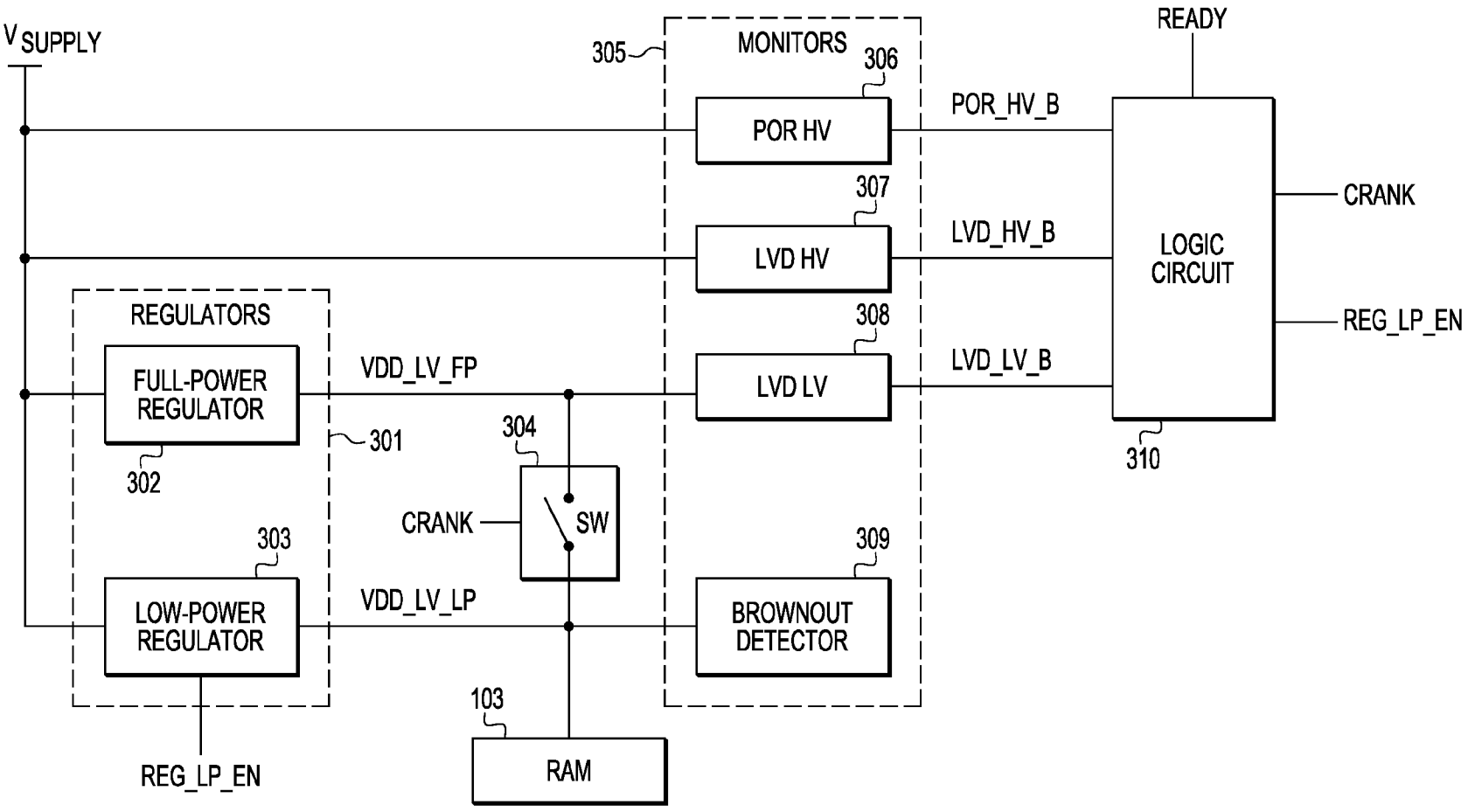
FIG. 3 is a block diagram of an example of a power management controller configured to manage cold-crank events according to some embodiments.

FIG. 3 is a block diagram of an example of PMC 104 configured to manage cold-crank events according to some embodiments. Specifically, PMC 104 may include two or more power or voltage regulators 301, here shown as first regulator 302 and second regulator 303, both configured to receive supply voltage $V_{SUPPLY}$ from a battery source subject to cold-cranking events, such as an automotive battery or the like. For example, first regulator 302 may be a full-power regulator and second regulator 303 may be low- or reduced-power regulator.

During a cold-crank event, second regulator 303 is enabled; otherwise when in normal operation first regulator 302 is enabled and second regulator 303 is disabled. First regulator 302 is configured to output a first voltage value "VDD_LV_FP" and second regulator 303 is configured to output a second voltage value "VDD_LV_LP." Second regulator 303 is also configured to receive a "REG_LP_EN" signal, which is an active-high enable control.

First regulator 302 is coupled to a first terminal of switching circuit 304, and second regulator 303 is coupled to a second terminal of switching circuit 304. In various embodiments, switching circuit 304 may be configured to receive a "CRANK" signal that controls the closing (conductive) and opening (non-conductive) of switching circuit 304. The CRANK signal may also control an amount of current limitation imposed by switching circuit 304 when switching circuit 304 is closed during a crank recovery process.

Switching circuit 304 may open when the cold-crank event is detected and it may close in current limitation mode during the crank recovery process. Memory circuit 103—in this case a Random Access Memory (RAM)—is coupled to the second terminal of switching circuit 304.

Monitor section 305 includes a plurality of monitoring circuits such as Power-on-Reset (POR) HV monitor 306 and Low Voltage Detector (LVD) High Voltage (HV) monitor 307, which are coupled to $V_{SUPPLY}$ and configured to output signals "POR_HV_B" and "LVD_HV_B," respectively. LVD Low Voltage (LV) monitor 308 is coupled to the first terminal of switching circuit 304 and is configured to output signal "LVD_LV_B." In addition, brownout circuit 309 is coupled to the second terminal of switching circuit 304, and it is configured to monitor memory 103's supply during the cold-crank event.

In operation, POR HV monitor 306 is configured to output POR_HV_B. Particularly, POR_HV_B is an active-low flag that monitors $V_{SUPPLY}$. When $V_{SUPPLY}$ drops below a threshold value ($V_{TH1}$) representing the minimum voltage level where the references and regulators are reliable, POR_HV_B goes to a logic low (i.e., asserted). In this case, second regulator 303 is automatically disabled and the brownout flag is forced to the engaged state (i.e., memory 103's content is lost).

LVD HV monitor 307 is configured to output LVD_HV_B, which is an active-low flag that also monitors $V_{SUPPLY}$. When $V_{SUPPLY}$ is smaller than another threshold value ($V_{TH2}$ greater than $V_{TH1}$), LVD_HV_B goes to a logic low (i.e., asserted) and switching circuit 304 is automatically opened to isolate memory 103 from the full-power domain. Conversely, LVD LV monitor 308 is configured to output LVD_LV_B, which is an active-low flag that monitors the output of first regulator 302.

Logic circuit 310 is configured to receive the POR_HV_B, LVD_HV_B, and LVD_LV_B signals as well as a "READY" signal, process those signals, and output the CRANK signal to switching circuit 304 and the REG_LP_EN signal to second regulator 303. The READY flag is an active high flag that indicates when memory 103 is ready to be used. If LVD_HV_B is at a logic low, the READY flag also goes to a logic low.

In some embodiments, logic circuit 310 may be configured to differentiate between a cold-crank event and normal power up. An example of logic circuit 310 as well as additional explanations how logic circuit 310 processes the aforementioned signals is provided in connection with FIG. 6.

Figure 4:
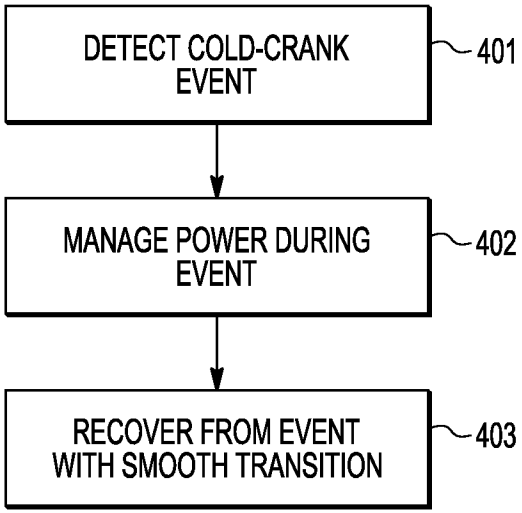
FIG. 4 is a flowchart of an example of a method for managing cold-crank events according to some embodiments.

FIG. 4 is a flowchart of method 400 for managing cold-crank events. In some embodiments, method 400 may be performed, at least in part, by PMC 104 shown in FIG. 3. Briefly, PMC 104 may be configured to promote preservation of content stored in memory 103 by detecting a cold-crank event at block 401, managing the power provided to memory 103 during the cold-crank event at block 402 (for instance, in contradistinction to a power-up process), and then performing a smooth transition to normal "run mode" during a recovery time at block 403.

In some implementations, the cold-crank event detection of block 401 may be performed at least in part with POR HV monitor 306, which monitors $V_{SUPPLY}$ provided to regulators 301. When signal POR_HV_B is engaged, second regulator 303 is automatically enabled and switching circuit 304 is opened to isolate memory 103 from the full-power domain. At block 402 during the cold-crank event, second regulator 303 supplies memory 103 and brownout detector 309 is used to monitor that supply. If $V_{SUPPLY}$ drops to a level where voltage references are not reliable, a safe-stating signal may disable second regulator 303 and force a brownout flag to the engaged state.

At block 403, when the cold-crank event ends and switching circuit 304 is closed, the charge distribution between capacitances on different power domains (and leakage on the full-power domain), may cause the voltage on the low-power domain to drop significantly, which may cause an undesired reset of memory 103. To address these, and other concerns, switching circuit 304 may be set to a current limitation mode along with a flag to differentiate the crank recovery from a normal power up. In the case of a crank recovery, switching circuit 304 may be closed but the current through may be limited to a predetermined value. Additionally or alternatively, second regulator 303 may be turned-off only when a voltage monitor on the full-power domain is released.

Figure 5:
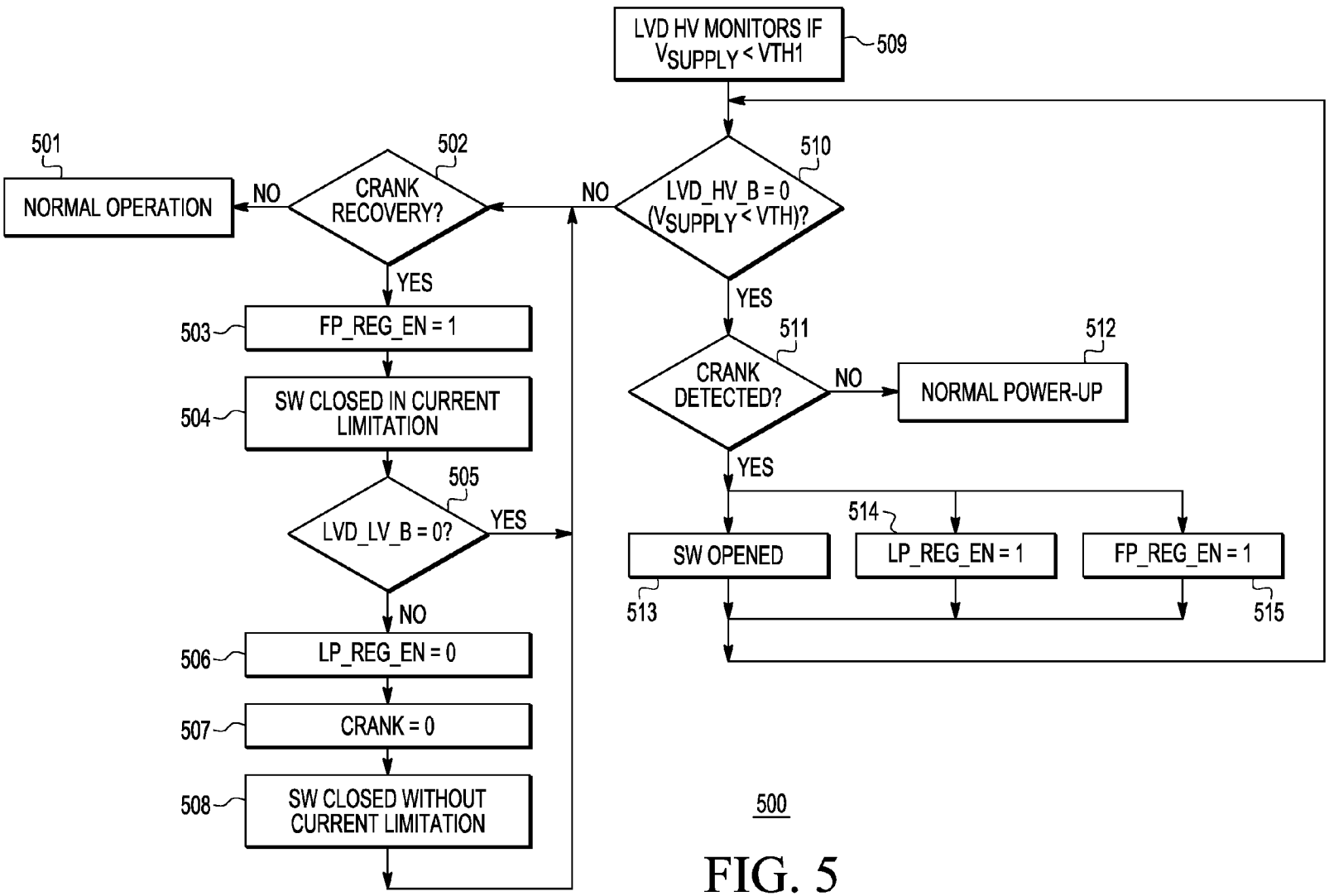
FIG. 5 is a flowchart of an example of a method for enabling a smooth transition during a recovery period following a cold-crank event according to some embodiments.

FIG. 5 is a flowchart of method 500 for enabling a smooth transition during a recovery period following a cold-crank event. In some embodiments, method 500 may be performed, at least in part, by switching circuit 304. At block 501, method 500 includes operating in normal mode. Block 502 evaluates whether crank recovery is ongoing. If not, control remains at block 501. Otherwise, first regulator 302 is enabled (FP_RG_EN is set to a logic high) in block 503 and switching circuit 304 is closed in current limitation mode at block 504. At block 505, if LVD_LV_B is not at a logic low, block 506 disables second regulator 303 (LP_REG_EN is set to a logic low), block 507 also sets CRANK to a logic low, and block 508 closes switching circuit 304 without current limitation. After block 508 and/or if LVD_LV_B is at a logic low at block 505, control returns to block 502.

At block 509, LVD HV 307 monitors whether $V_{SUPPLY}$ is smaller than a selected threshold ($V_{TH1}$). Block 510 determines whether LVD_HV_B is at a logic low. If not, control passes to block 502. Otherwise block 511 determines whether CRANK is at a logic high. If not, block 512 performs one or more normal power up operations. If so, block 513 opens switching circuit 513, second regulator is enabled (LP_REG_EN is set to a logic high) at block 514, first regulator 302 is disabled (FP_REG_EN is set to a logic low) at block 515, and control returns to block 510.

Accordingly, blocks 510-512 correspond to block 401 of FIG. 4, and also to curves discussed in connection with FIGS. 7 and 8 below. Particularly, block 510 detects a cold crank event by sensing $V_{SUPPLY}$ and using logic circuit 310 to distinguish that type of event from a power-up. When $V_{SUPPLY}$ is smaller than the selected threshold level $V_{TH1}$, block 510 identifies the cold crank event. Blocks 513-515 correspond to block 402 of FIG. 4, and to curves shown in FIG. 8. That is, in response to the crank event, RAM 103 is isolated by opening switching circuit 304, enabling second regulator 303, and disabling first regulator 302. When $V_{SUPPLY}$ increases again and becomes greater that the selected threshold $V_{TH1}$, the recovery process begins.

Figures 8, 9:
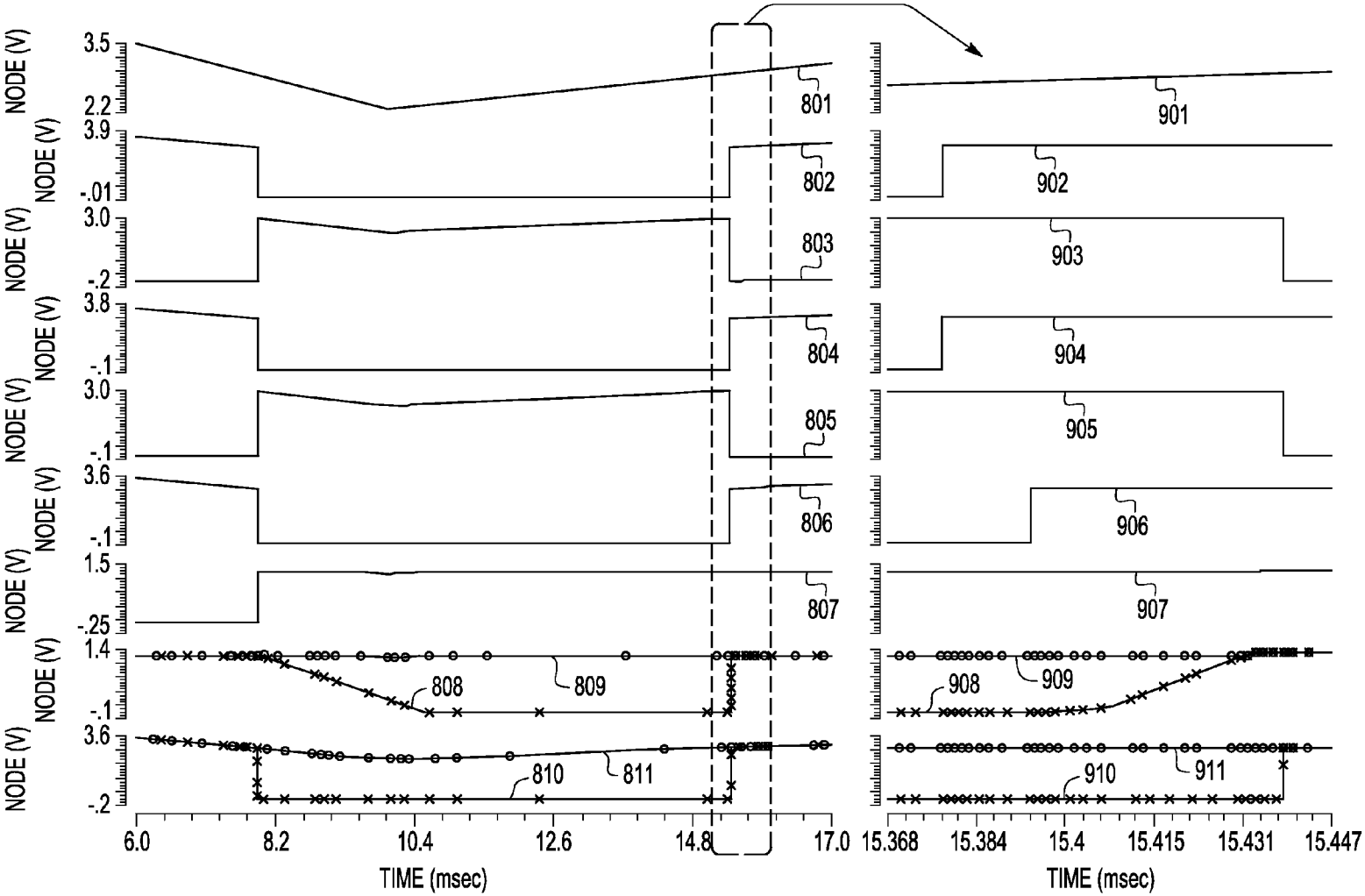
FIGS. 8 and 9 show graphs illustrating an example of a cold-crank event identified according to some embodiments.

In that regard, blocks 502-508 correspond to block 403 in FIG. 4, and to curves shown in FIG. 8. So long as $V_{SUPPLY}$ is greater than the selected threshold $V_{TH1}$ (LVD_HV_B is de-asserted) and CRANK is still at a logic high, which means that the crank event is finishing and method 500 enables first regulator 302 and closes switching circuit 304. However, when switching circuit 304 is closed there can be a charge distribution between first regulator 302 and second regulator 303, and the contents of RAM 103 may be lost. To address this, method 500 operates within the loop formed by blocks 502-508 until the power domain provided by first regulator 302 meets a predetermined minimum voltage level.

Figure 6:
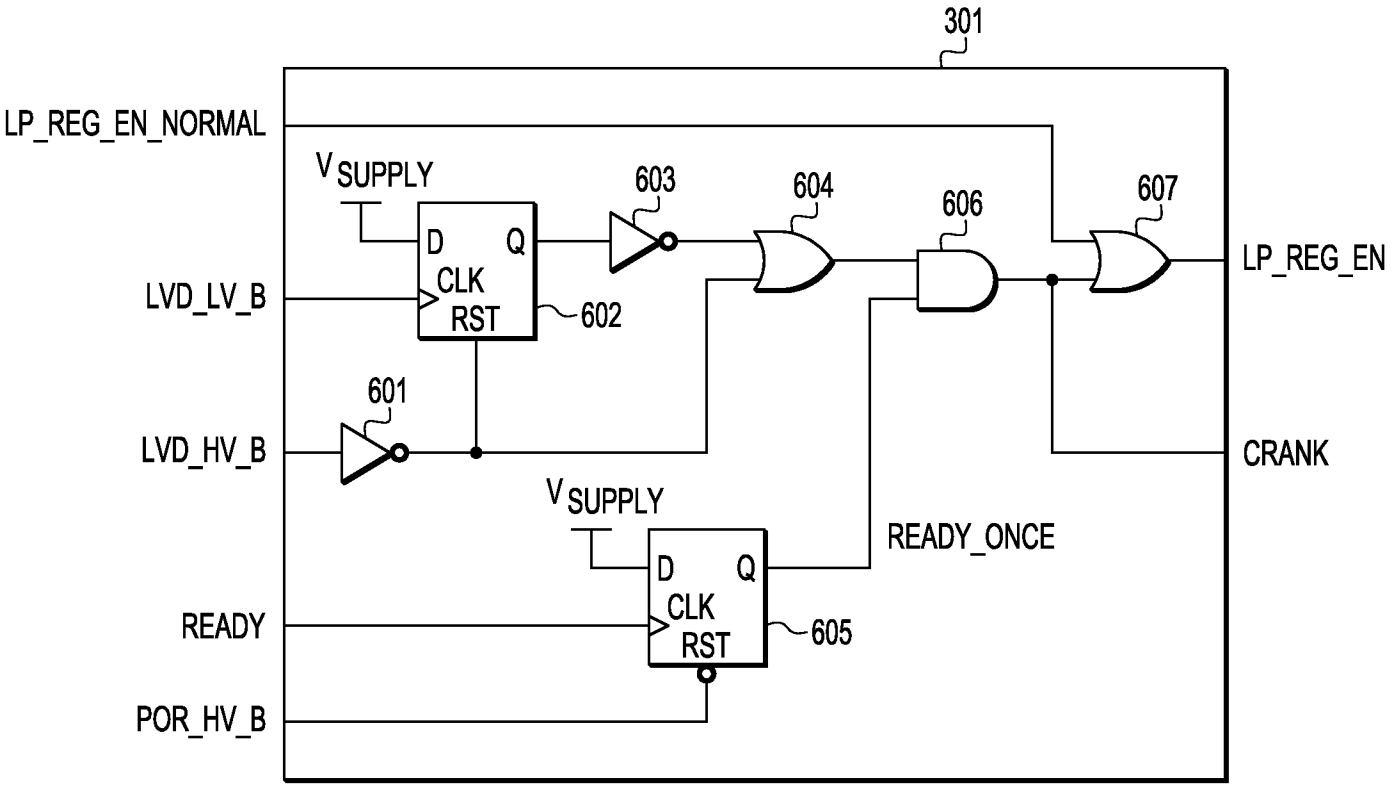
FIG. 6 is a block diagram of an example of a logic circuit configured to handle cold-crank events and control a switching circuit to manage a recovery process according to some embodiments.

FIG. 6 is a block diagram of logic circuit 310 configured to handle cold-crank events and control switching circuit 304 to manage a recovery process. Operation of logic components 601-607 is further illustrated with respect to FIGS. 7-9. In this embodiment, signal LVD_LV_B is received at a clock input of D-type flip-flop 602, which also receives $V_{SUPPLY}$ at its D input. Signal LVD_HV_B is received at the input of inverter 601, the output of which is coupled to the reset input of flip-flop 602. The Q output of flip-flop 602 is coupled to the input of inverter 603, and the output of inverter 603 is coupled to a first input of OR gate 604. The output of inverter 601 is then coupled to the second input of OR gate 604, the output of which is coupled to a first input of AND gate 606.

READY signal is coupled to the clock input of D-type flip-flop 605, and POR_HV_B signal is coupled to the reset input of flip-flop 605. The D input of flip-flop 605 receives $V_{SUPPLY}$, and the Q output of flip-flop 605 provides a READY_ONCE signal to the second input of AND gate 606. The output of AND gate 606 provides the CRANK signal. OR gate 607 receives at its inputs the output of AND gate 606 as well as LP_REG_EN_NORMAL signal. Then, the output of OR gate 607 provides the LP_REG_EN signal.

The READY_ONCE signal is an active-high flag that is asserted when READY is asserted (i.e., goes to logic high) but it is not de-asserted when the READY flag is de-asserted. Meanwhile, the CRANK signal is an active-high flag that indicates the occurrence of a cold-crank event. If READY_ONCE is low, the CRANK signal automatically goes to low. If READY_ONCE is high, the CRANK signal goes to HIGH when LVD_LV_B goes to low and only returns to low when LVD_HV_B and LVD_LV_B are de-asserted. If the CRANK signal is asserted, second regulator 303 is automatically enabled to supply memory 103, and switching circuit 304 is closed but in current limitation mode.

The LP_REG_EN_NORMAL signal is an active-high enable control for the second regulator 303 in normal mode. If the LVD_HV_B signal is at a logic low, the LP_REG_EN_NORMAL is also set to a low logic value.

Figure 7:
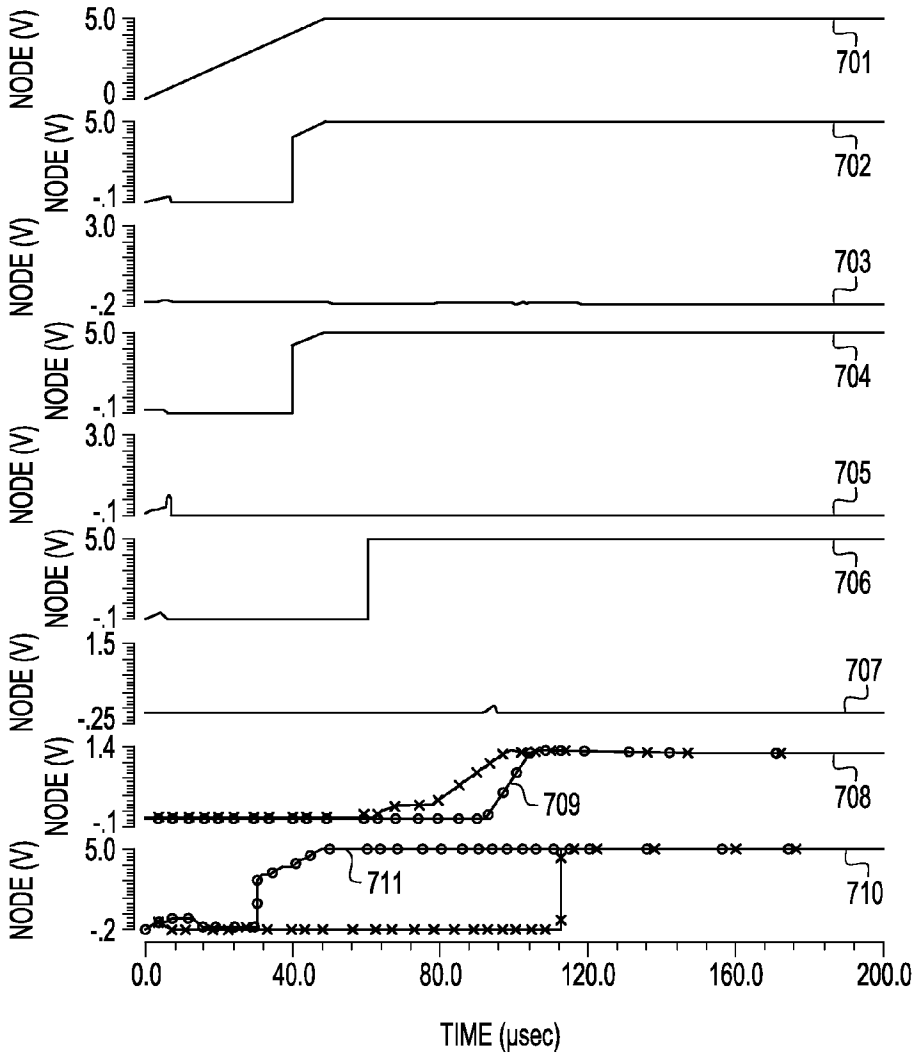
FIG. 7 shows graphs illustrating an example of a power up process identified according to some embodiments.

FIG. 7 shows graphs illustrating a power up process identified, at least in part, by logic circuit 310 of FIG. 6 according to some embodiments. Particularly, curve 701 shows $V_{SUPPLY}$ varying over time. In this case, curve 701 shows main power supply $V_{SUPPLY}$ increasing linearly from 0 V to 5 V. Curve 702 shows the POR_HV_B signal, which begins at a logic low and moves to a logic high slightly before $V_{SUPPLY}$ reaches 5 V. Curve 703 shows the CRANK signal, which stays at a logic low because logic circuit 310 identifies curve 701 as part of a start-up process, rather than the result of a cold-crank event.

Curve 704 shows that switching circuit 304 is turned on (conductive) at the same time that the POR_HV_B signal of curve 702 becomes high. Curve 705 shows that the LP_REG_EN_NORMAL signal remains low throughout the start-up. Curve 706 shows an enabling signal for first regulator 302. Curve 707 shows that a brownout flag remains at a logic low throughout the start-up process. Curves 708 and 709 show the voltage levels at the first and second terminals of switching circuit 304, respectively. Finally, curve 710 shows the READY signal, and curve 711 shows a bandgap flag indicating that a bandgap circuit (not shown) is operational and capable of providing a process-voltage-temperature (PVT) invariant voltage reference to other circuits.

In sum, curves 701-711 show that, during a normal power-up process (as opposed to a cold-crank event), the CRANK signal is low due to the READY flag being low when the LVD_HV_B flag is de-asserted. Then, switching circuit 304 is closed without current limitation, and the LP_REG_EN flag is not enabled.

FIGS. 8 and 9 show graphs illustrating a cold-crank event identified, at least in part, by logic circuit 310 of FIG. 6 according to some embodiments. Particularly, curves 801 and 901 show $V_{SUPPLY}$ varying over time and reaching a minimum functional voltage (or POR trip point). Curves 802 and 902 show the POR_HV_B signal, which begins at a logic high and is then asserted to open switching circuit 304. Also, curve 902 zooms in at the point in time when the POR_HV_B signal is de-asserted. Curves 803 and 903 show the CRANK signal, which was asserted low when the POR was also at a logic low but then goes high at the same time as the POR_HV_B signal is asserted as the result of a cold-crank event, in contrast with the start-up process example of FIG. 7.

Curves 804 and 904 show that switching circuit 304 is turned off (non-conductive) at the same time that the POR_HV_B signal of curve 802 becomes high, and then turned on (conductive) when POR_HV_B goes low. Here, however, switching circuit 304 is turned on in current limitation mode to promote charge distribution between regulators 302 and 303. Once the CRANK signal of curve 803 is turned on, the LP_REG_EN_NORMAL flag of curve 805 is also asserted in order to turn second regulator 303 on. Curve 905 shows that the LP_REG_EN_NORMAL flag assumes a logic low value when the CRANK signal of curve 903 is de-asserted.

Curves 806 and 906 show the enabling signal for first regulator 302. Curves 807 and 907 show that the brownout flag is cleared when the POR_HV_B signal is asserted. Curves 808-908 and 809-909 show the voltage levels at the first and second terminals of switching circuit 304, respectively. Also, curves 810 and 910 shows the READY signal, and curves 811 and 911 show the bandgap flag always asserted.

In summary, in this example, $V_{SUPPLY}$ reaches a minimum functional voltage or POR trip point. When the POR_HV_B signal is asserted, switching circuit 304 opens, first regulator 302 is disabled, and the brownout flag is cleared. Because the first power-up process is completed, that is, the READY signal is high, then the CRANK signal goes high when POR_HV_B is asserted, thus identifying a cold-crank event. Also, when the CRANK signal is asserted second regulator 304 is enabled in order to keep the voltage at the second terminal of switch 304 stable thereby preventing the loss contents stored in memory 103.

Figure 10:
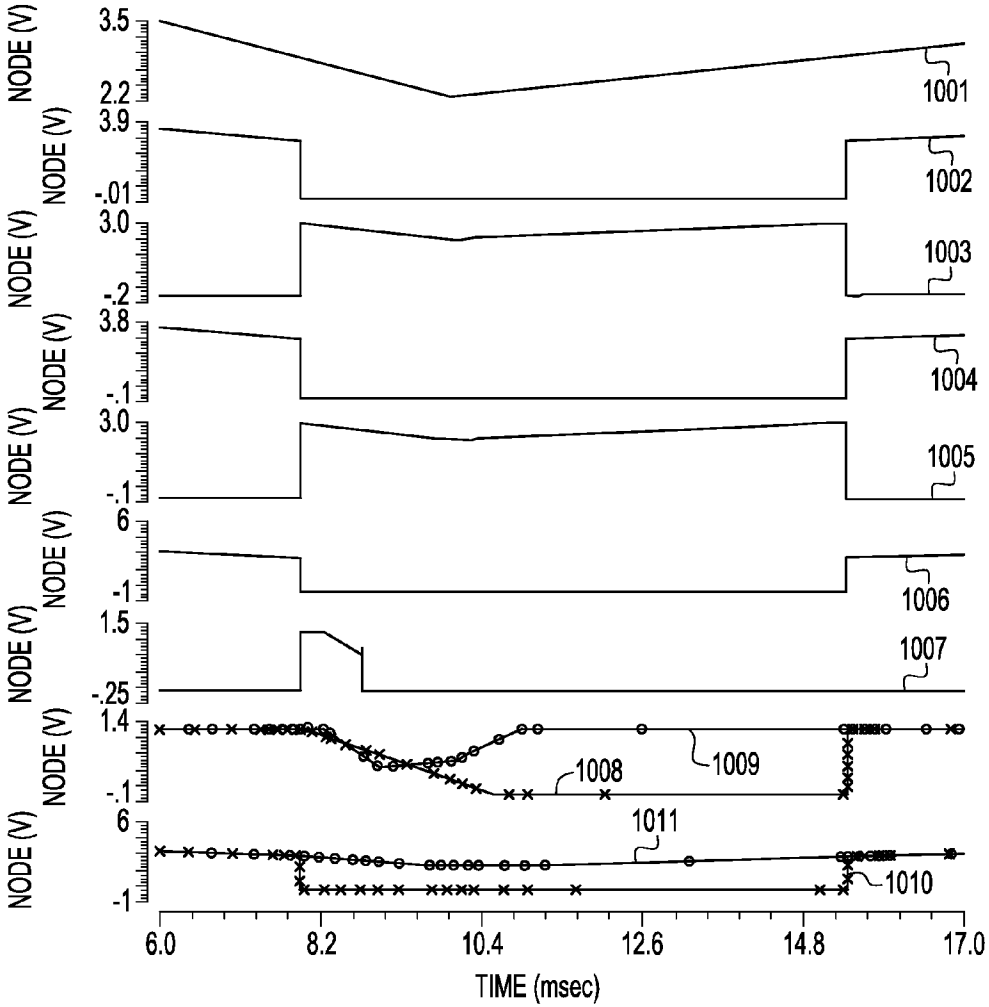
FIG. 10 shows graphs illustrating an example of a cold-crank event setting a brownout flag according to some embodiments.

FIG. 10 shows graphs illustrating a cold-crank event setting a brownout flag according to some embodiments. In this example, the same sequence of events shown in curves 801-811 is repeated in curves 1001-1011, respectively. But here, during the cold-crank event, an overload condition occurs such that the output of second regulator 303 drops below a minimum memory retention voltage (e.g., below 0.7 V). Accordingly, the brownout flag shown in curve 1007 is asserted and continues asserted after crank recovery to indicate that the contents of memory 103 should not be trusted.

Figure 11:
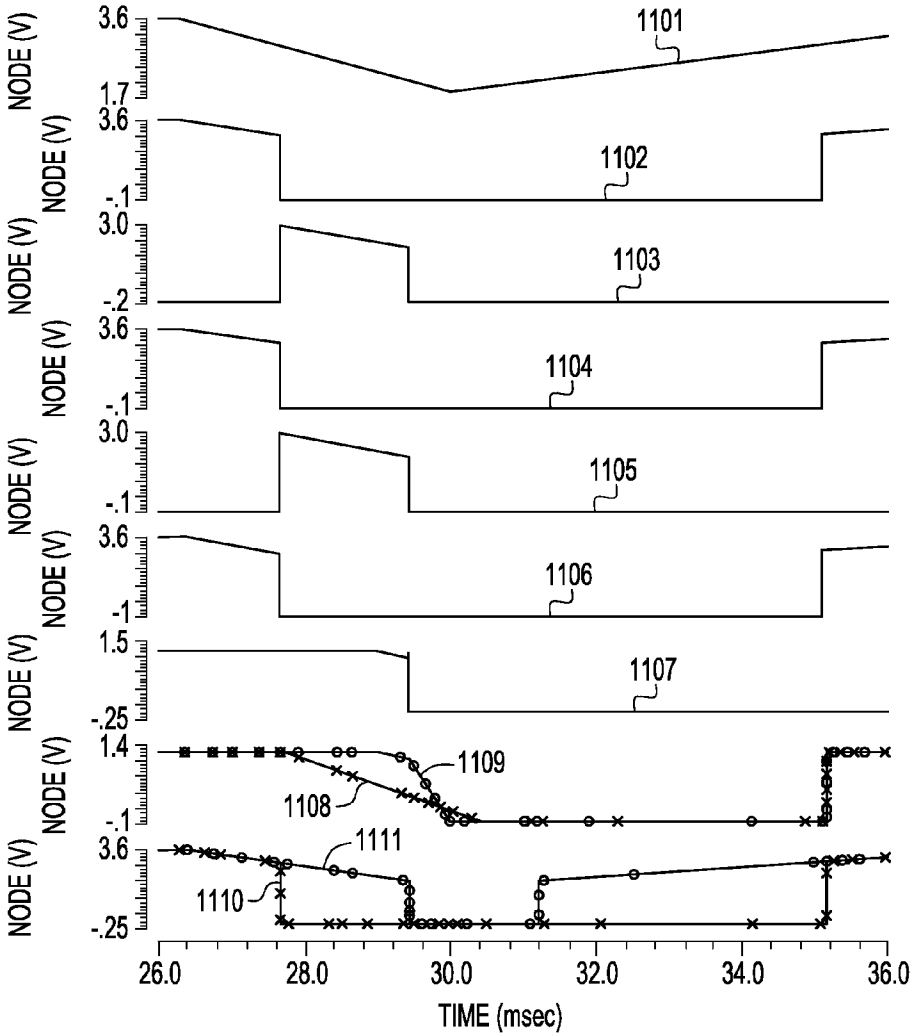
FIG. 11 shows graphs illustrating an example of a cold-crank event setting a bandgap flag according to some embodiments.

FIG. 11 shows graphs illustrating a cold-crank event setting a bandgap flag according to some embodiments. Again, the same sequence of events shown in curves 801-811 is repeated in curves 1101-1111, respectively. However, in this example the crank is stronger and $V_{SUPPLY}$ drops below a bandgap circuit and second regulator 303's minimum supply range. Because of that, the CRANK signal goes low, second regulator 303 is disabled and the brownout flag is asserted (and continues to be asserted after crank recovery). In other words, in some implementations, bandgap monitoring may have priority over brownout monitoring.

As described herein, in an illustrative, non-limiting embodiment, an electronic device may include detecting a cold-crank event and, in response to detecting the cold-crank event, setting a switching circuit to a non-conductive state, wherein the switching circuit is configured to couple a first power regulator to a memory circuit, and wherein setting the switching circuit to the non-conductive state de-couples the memory circuit from the first power regulator. The method may also include setting the switching circuit to a conductive state in current limitation mode during a recovery period following the cold-crank event, wherein setting the switching circuit to the conductive state re-couples the memory circuit to the first power regulator.

For example, the first voltage regulator may be configured to provide a first amount of power to the memory circuit when the switching circuit is set to the conductive state, a second voltage regulator coupled to the memory circuit may be configured to provide a second amount of power to the memory circuit when the switching circuit is set to the non-conductive state, the first and second power regulators may each be coupled to different terminals of the switching circuit, and the first amount of power may be greater than the second amount of power.

The method may also include turning off the first power regulator and turning on the second power regulator in response to detecting the cold-crank event. The method may further include turning on the first power regulator and turning off the second power regulator in connection with the setting of the switching circuit to the conductive state in current limitation mode. The method may also include reducing an amount of current limitation provided by the switching circuit in the current limitation mode. In some cases, detecting the cold-crank event may include distinguishing the cold-crank event from a power-up event.

In another illustrative, non-limiting embodiment, an electronic device may include a switching circuit, a first power regulator coupled to a first terminal of the switching circuit, a second power regulator coupled to a second terminal of the switching circuit, and a logic circuit coupled to the switching circuit, where the logic circuit is configured to make the switching circuit non-conductive in response to detection of a cold-crank event, and where the logic circuit is configured to make the switching circuit conductive in current limitation mode during a recovery period following the cold-crank event. The electronic device may also include a memory circuit coupled to the second terminal of the switching circuit.

In some implementations, the second voltage regulator may be configured to provide power to the memory circuit during the cold-crank event. The first voltage regulator may be configured to provide a first amount of power to the memory circuit during a first mode of operation, the second voltage regulator may be configured to provide a second amount of power to the memory circuit during a second mode of operation, and the first amount of power may be greater than the second amount of power. The cold-crank event may the turning off of the first power regulator and the turning on of the second power regulator, and the recovery period may include a turning off of the second power regulator and a turning on of the first power regulator.

In some cases, the logic circuit may be further configured to reduce an amount of current limitation provided by the switching circuit during the recovery period, and/or to distinguish the cold-crank event from a power up event. For example, the logic circuit may be coupled to a power-on-reset monitoring circuit configured to determine that a power-on-reset signal is applied to the first and second power regulators, a high voltage monitoring circuit configured to determine that a supply voltage provided to the first and second power regulators meets a high voltage threshold, and a low voltage monitoring circuit configured to determine that a voltage at the first terminal of the switching circuit meets a low voltage threshold.

The electronic device may also include a brownout detector circuit coupled to the second terminal of the switching circuit, the brownout circuit configured to determine that a voltage applied to the memory circuit has reached a predetermined level.

In yet another illustrative, non-limiting embodiment, a method may include detecting initiation of a cold-crank event and in response to the detection, setting a switching circuit to a non-conductive state, where the switching circuit includes a first terminal coupled to a first power regulator, and where the switching circuit includes a second terminal coupled to a second power regulator and to a memory circuit. The method may also include setting the switching circuit to a conductive state in current limitation mode during a recovery period following the initiation of cold-crank event to prevent loss of data in the memory circuit.

The first voltage regulator may be configured to provide a first amount of power to the memory circuit during a first mode of operation, the second voltage regulator may be configured to provide a second amount of power to the memory circuit during a second mode of operation, and the first amount of power may be greater than the second amount of power.

The cold-crank event may cause the turning off of the first power regulator and the turning on of the second power regulator, and the recovery period may include a turning off of the second power regulator and a turning on of the first power regulator. The method may also include reducing an amount of current limitation provided by the switching circuit during the recovery period. The method may further include detecting the initiation of the cold-crank event includes distinguishing the cold-crank event from a power up event. The method may also include determining that a voltage applied to the memory circuit has reached a predetermined level, and setting a brownout flag in response to the determination.

In many implementations, the systems and methods disclosed herein may be incorporated into a wide range of electronic devices including, for example, computer systems or Information Technology (IT) products such as servers, desktops, laptops, memories, switches, routers, etc.; telecommunications hardware; consumer devices or appliances such as mobile phones, tablets, television sets, cameras, sound systems, etc.; scientific instrumentation; industrial robotics; medical or laboratory electronics such as imaging, diagnostic, or therapeutic equipment, etc.; transportation vehicles such as automobiles, buses, trucks, trains, watercraft, aircraft, etc.; military equipment, etc. More generally, these systems and methods may be incorporated into any device or system having one or more electronic parts or components.

Figure 12:
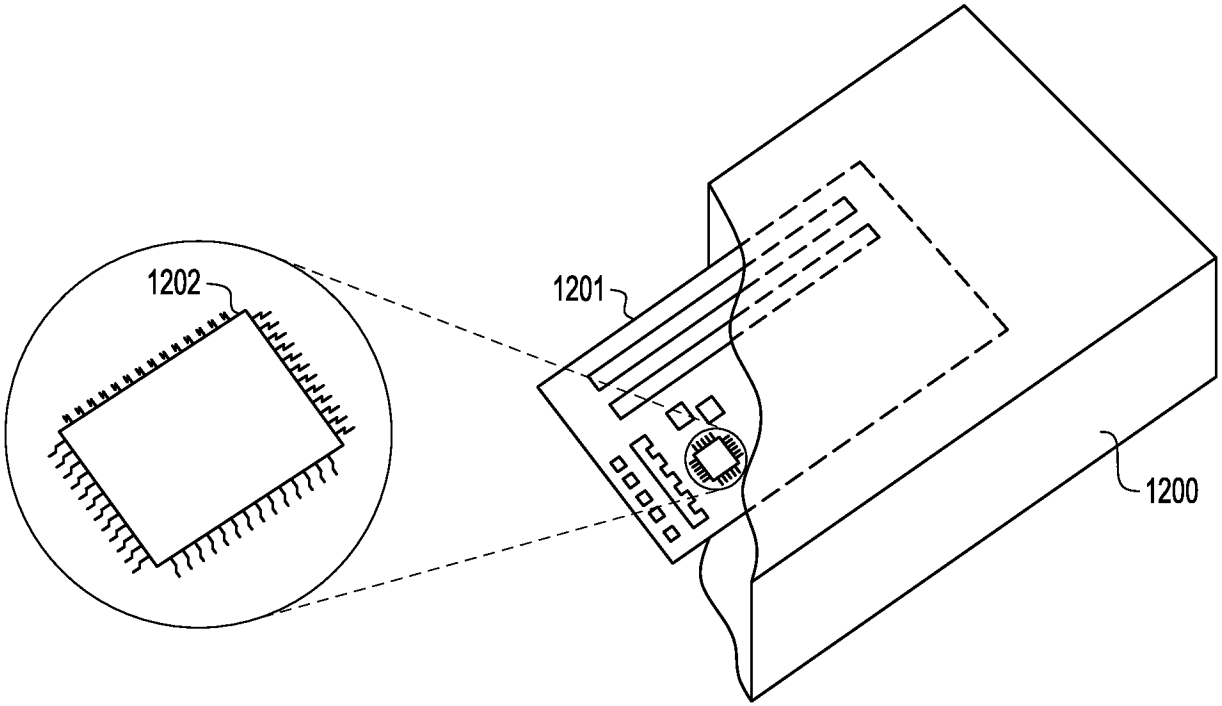
FIG. 12 is a diagram of an example of an electronic system having one or more electronic microelectronic device packages, according to some embodiments.

Turning to FIG. 12, a block diagram of electronic system 1200 is depicted. In some embodiments, electronic system 1200 may be include of the aforementioned electronic devices, or any other electronic device. As illustrated, electronic system 1200 includes one or more Printed Circuit Boards (PCBs) 1201, and at least one of PCBs 1201 includes one or more microelectronic device packages(s) 1202. In some implementations, device package(s) 1202 may include one or more circuits for managing cold-crank events as discussed above.

Examples of device package(s) 1202 may include, for instance, a System-On-Chip (SoC), an Application Specific Integrated Circuit (ASIC), a Digital Signal Processor (DSP), a Field-Programmable Gate Array (FPGA), a processor, a microprocessor, a controller, a microcontroller (MCU), a Graphics Processing Unit (GPU), or the like. Additionally or alternatively, device package(s) 502 may include a memory circuit or device such as, for example, a Random Access Memory (RAM), a Static RAM (SRAM), a Magnetoresistive RAM (MRAM), a Nonvolatile RAM (NVRAM, such as "FLASH" memory, etc.), and/or a Dynamic RAM (DRAM) such as Synchronous DRAM (SDRAM), a Double Data Rate RAM, an Erasable Programmable ROM (EPROM), an Electrically Erasable Programmable ROM (EEPROM), etc. Additionally or alternatively, device package(s) 902 may include one or more mixed-signal or analog circuits, such as, for example, Analog-to-Digital Converter (ADCs), Digital-to-Analog Converter (DACs), Phased Locked Loop (PLLs), oscillators, filters, amplifiers, etc. Additionally or alternatively, device package(s) 902 may include one or more Micro-ElectroMechanical Systems (MEMS), Nano-ElectroMechanical Systems (NEMS), or the like.

Generally speaking, device package(s) 1202 may be configured to be mounted onto PCB 1201 using any suitable packaging technology such as, for example, Ball Grid Array (BGA) packaging or the like. In some applications, PCB 1201 may be mechanically mounted within or fastened onto electronic device 1200. It should be noted that, in certain implementations, PCB 901 may take a variety of forms and/or may include a plurality of other elements or components in addition to device package(s) 1202. It should also be noted that, in some embodiments, PCB 901 may not be used and/or device package(s) 1202 may assume any other suitable form(s).

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An electronic device, comprising:

a switching circuit;

a first power regulator coupled to a first terminal of the switching circuit;

a second power regulator coupled to a second terminal of the switching circuit;

a logic circuit configured to detect a cold crank event of an internal combustion engine by sensing a supply voltage, wherein the logic circuit is coupled to the switching circuit, wherein the logic circuit is configured to make the switching circuit non-conductive in response to detection of the cold-crank event, and wherein the logic circuit is configured to make the switching circuit conductive in current limitation mode during a recovery period following the cold-crank event; and a memory circuit coupled to the second terminal of the switching circuit, wherein the first voltage regulator is configured to provide a first amount of power to the memory circuit during a first mode of operation, wherein the second voltage regulator is configured to provide a second amount of power to the memory circuit during a second mode of operation, and wherein the first amount of power is greater than the second amount of power.

2. The electronic device of claim 1, wherein the second voltage regulator is configured to provide power to the memory circuit during the cold-crank event.

3. The electronic device of claim 1, wherein the cold-crank event triggers the turning off of the first power regulator and the turning on of the second power regulator, and wherein the recovery period includes a turning off of the second power regulator and a turning on of the first power regulator.

4. The electronic device of claim 1, wherein the logic circuit is further configured to control an amount of current limitation provided by the switching circuit during the recovery period.

5. The electronic device of claim 1, further comprising a brownout detector circuit coupled to the second terminal of the switching circuit, the brownout circuit configured to determine that a voltage applied to the memory circuit has reached a predetermined level.

6. A method, comprising:

detecting initiation of a cold-crank event of an internal combustion engine by sensing a supply voltage using a logic circuit;

in response to the detection, setting a switching circuit to a non-conductive state, wherein the switching circuit includes a first terminal coupled to a first power regulator, and wherein the switching circuit includes a second terminal coupled to a second power regulator and to a memory circuit; and setting the switching circuit to a conductive state in current limitation mode during a recovery period following the initiation of cold-crank event to prevent loss of data in the memory circuit, wherein the first voltage regulator is configured to provide a first amount of power to the memory circuit during a first mode of operation, wherein the second voltage regulator is configured to provide a second amount of power to the memory circuit during a second mode of operation, and wherein the first amount of power is greater than the second amount of power.

7. The method of claim 6, wherein the cold-crank event causes the turning off of the first power regulator and the turning on of the second power regulator, and wherein the recovery period includes a turning off of the second power regulator and a turning on of the first power regulator.

8. The method of claim 6, further comprising reducing an amount of current limitation provided by the switching circuit during the recovery period.

9. The method of claim 6, wherein detecting the initiation of the cold-crank event includes distinguishing the cold-crank event from a power up event.

10. The method of claim 6, further comprising determining that a voltage applied to the memory circuit has reached a predetermined level, and setting a brownout flag in response to the determination.

11. An electronic device, comprising:

a switching circuit;

a first power regulator coupled to a first terminal of the switching circuit;

a second power regulator coupled to a second terminal of the switching circuit;

a logic circuit configured to detect a cold crank event of an internal combustion engine by sensing a supply voltage, wherein the logic circuit is coupled to the switching circuit, wherein the logic circuit is configured to make the switching circuit non-conductive in response to detection of the cold-crank event, and wherein the logic circuit is configured to make the switching circuit conductive in current limitation mode during a recovery period following the cold-crank event; and a memory circuit coupled to the second terminal of the switching circuit, wherein the logic circuit is coupled to a power-on-reset monitoring circuit configured to determine that a power-on-reset signal is applied to the first and second power regulators, a high voltage monitoring circuit configured to determine that a supply voltage provided to the first and second power regulators meets a high voltage threshold, and a low voltage monitoring circuit configured to determine that a voltage at the first terminal of the switching circuit meets a low voltage threshold.

12. An electronic device, comprising:

a switching circuit;

a first power regulator coupled to a first terminal of the switching circuit;

a second power regulator coupled to a second terminal of the switching circuit;

a logic circuit configured to detect a cold crank event of an internal combustion engine by sensing a supply voltage, wherein the logic circuit is coupled to the switching circuit, wherein the logic circuit is configured to make the switching circuit non-conductive in response to detection of the cold-crank event, and wherein the logic circuit is configured to make the switching circuit conductive in current limitation mode during a recovery period following the cold-crank event;

a memory circuit coupled to the second terminal of the switching circuit; and a brownout detector circuit coupled to the second terminal of the switching circuit, the brownout circuit configured to determine that a voltage applied to the memory circuit has reached a predetermined level.

13. A method, comprising:

detecting initiation of a cold-crank event of an internal combustion engine by sensing a supply voltage using a logic circuit;

in response to the detection, setting a switching circuit to a non-conductive state, wherein the switching circuit includes a first terminal coupled to a first power regulator, and wherein the switching circuit includes a second terminal coupled to a second power regulator and to a memory circuit;

setting the switching circuit to a conductive state in current limitation mode during a recovery period following the initiation of cold-crank event to prevent loss of data in the memory circuit; and determining that a voltage applied to the memory circuit has reached a predetermined level, and setting a brown-out flag in response to the determination.

* * * * *